US005594998A

United States Patent [19]

Eriksen et al.

[11] Patent Number: 5,594,998

[45] Date of Patent: Jan. 21, 1997

[54] HEATABLE SHIELD FOR HEAT TREATMENT OF PAPER-MAKING MACHINE TEXTILES

[75] Inventors: Gunnar Eriksen, Borgen; Sissel W. Olsen, Tranby, both of Norway

[73] Assignee: Kvaerner Eureka a.s, Tranby, Norway

[21] Appl. No.: 605,621

[22] Filed: Feb. 22, 1996

[30] Foreign Application Priority Data

Mar. 8, 1995 [NO] Norway ..... 950888

[51] Int. Cl.[6] ..... D21F 1/00; D06C 3/00; F26B 13/10

[52] U.S. Cl. ..... 34/111; 34/116; 26/51

[58] Field of Search ..... 34/111, 110, 116, 34/454; 139/383 A; 26/51

[56] References Cited

U.S. PATENT DOCUMENTS

| | | | |
|---|---|---|---|
| 2,414,580 | 1/1947 | Birdseye | 34/111 |
| 3,337,968 | 8/1967 | Krikorian et al. | 34/116 |
| 4,513,517 | 4/1985 | Vedenpaa | 34/116 |
| 4,622,758 | 11/1986 | Lehtinen et al. | 34/116 |

FOREIGN PATENT DOCUMENTS

| | | | |
|---|---|---|---|
| 139899 | 9/1976 | Norway . | |
| 157339 | 11/1987 | Norway . | |
| 965095 | 7/1964 | United Kingdom | 34/116 |

*Primary Examiner*—Andy Falik
*Attorney, Agent, or Firm*—Young & Thompson

[57] ABSTRACT

A heat shield which is attached to a heatable roller in a stretching machine for the treatment of felt and wire cloths is designed to have channels for the heating medium extending in the machine direction. The ducts may be grouped in sections having a connection to an inlet and outlet manifold. Each section is attached to a by-pass. In this way a heating medium can be fed into the shield in controlled portions over the longitudinal direction of the shield thus obtaining the possibility of control and regulation of the temperature profile over the cross-section of the band.

3 Claims, 2 Drawing Sheets

HEATABLE SHIELD FOR HEAT TREATMENT OF PAPER-MAKING MACHINE TEXTILES

FIELD OF THE INVENTION

The invention relates to a device for the heat treatment of paper-making machine textiles which,in the form of a band, run over a heatable roller. The device comprises a heatable shield extending along a part of the periphery of the roller and adapted to the curvature of the roller, which is capable of applying heat to the band running over the roller from the outside of the band. The shield has internal ducts/channels for the through-flow of a heating medium.

BACKGROUND OF THE INVENTION

The invention has been especially developed in connection with heatable rollers for drying and thermosetting in a stretching machine for felt and wire cloths which are used in paper-making machines. The heatable roller is attached to a heat shield so as to obtain heat impact on the felt/wire cloth from the outside.

Oil-heated rollers, which today are the most commonly used heatable rollers in a stretching machine, are heated by thermo-oil flowing through air ducts or channels in the roller jacket. These ducts or channels are oriented in the cross-machine direction. The oil flow through the channels may be based upon a one-way flow or may be based upon the counterflow principle (alternating flow direction in adjacent channels). The oil acts as a thermofluid for the transport of heat to the roller. The oil temperature will fall en route as the oil emits heat, and this results in a temperature fall in the channels in the cross-machine direction. In a heating period, depending upon how rapidly the roller is heated, the temperature fall in the channels can be quite noticeable. However, once the roller has reached the chosen working temperature, the temperature fall in the oil will be low.

Hitherto, it has been usual to design the oil-heated heat shields according to the same principles as the rollers, with ducts or channels integrated into the shield and extending in the cross-machine direction.

A felt or wire cloth which passes over a heated roller will be subjected to expansion and contraction in the cross-machine direction. Along the free edges of the band, the band will expand or contract relatively freely, but in the interior of the band cross-section, that is in the centre of the band the band will have a poorer capacity for expansion. In order to achieve a more even felt quality, it is desirable to be able to control the temperature in the cross-machine direction, precisely because the felt in the centre is firmly fixed. Clearly therefore, there is a need to supply more or less heat along the edges of the band than in the center, so as to have control of and enhance the quality of the felt.

SUMMARY OF THE INVENTION

According to the invention, a device is proposed as mentioned by way of introduction, which device is characterized in that the channels are oriented in the machine direction and that the channels are designed to be capable of emitting, individually or in sections, different amounts of heat so that a temperature gradient is obtained across the band. In this way, the previous fall in temperature in the cross-machine direction is eliminated and the fall in temperature will now take place instead in the machine direction. However, a fall in temperature of this kind is of no significance because it will be integrated into the normal heating of the band.

The device according to the invention may to advantage be designed so that the channels are grouped in sections each of which is connected to an inlet and outlet manifold. A design of this kind allows for the control of the temperature profile in the cross-machine direction, the individual sections being capable of being supplied with the desired amount of heat.

The especially advantageous device according to the invention is characterized by a bypass for each section, having a pump installed in the thus formed by-pass circuit. A design of this kind gives particularly good control and regulation of the temperature profile in the cross-machine direction. The individual by-pass circuits may be subjected to individual temperature control, so that it will be possible to obtain a desired temperature profile in the cross-machine direction - for example, based on partial heating of the shield, or the use of higher temperatures at the edges of the band.

BRIEF DESCRIPTION OF THE DRAWINGS

The invention shall now be explained in more detail with reference to the drawings, wherein.

DETAILED DESCRIPTION OF THE INVENTION

Figure 1:
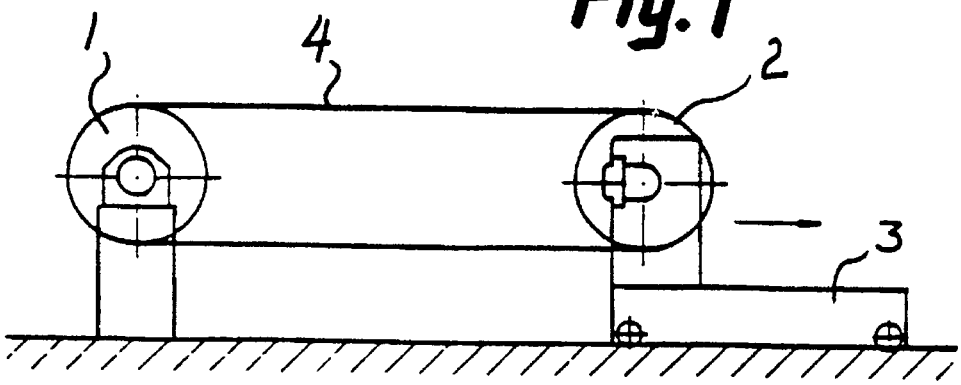
FIG. 1 is a purely schematic illustration of a stretching machine.
Figure 2:
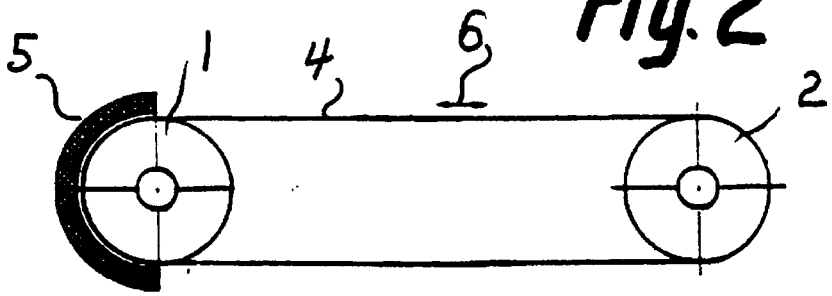
FIG. 2 shows the position of the band in the stretching machine, with a heat shield attached to one of the rollers.
Figure 3:
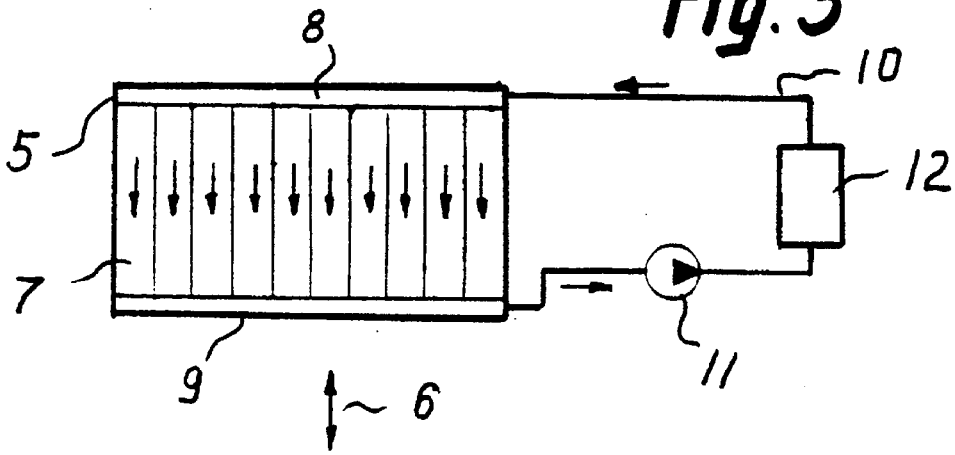
FIG. 3 is a flow diagram for the heat shield according to the invention.

The system illustrated in FIG. 1 is a stretching machine with a heatable roller 1 and a stretching roller 2, mounted in a stretching carriage 3. A band 4 which is to be treated is placed around the rollers 1 and 2. In FIG. 2, the rollers 1 and 2 and the band 4 are shown, in this figure it being shown how the heatable roller 1 is attached to a heat shield 5. This heat shield extends over a part of the periphery of the roller 1 and over the entire length of the roller (the cross-machine direction). According to the invention, the heat shield is provided with channels for the heating medium, said channels being oriented in the machine direction as is shown in FIG. 3. The machine direction is FIG. 2 is marked with a double arrow 6, and the machine direction is correspondingly marked in FIG. 3.

The schematically illustrated heat shield 5 in FIG. 3 is provided with channels 7 which run in the machine direction 6, i.e., they follow the direction of curvature of the shield. The channels 7 are connected to an inlet manifold 8 and an outlet manifold 9. An oil transporting pipe 10 comprises a pump 11 and a heat exchanger 12, where the heating medium, so-called thermo-oil, is given the desired temperature.

Figure 4:
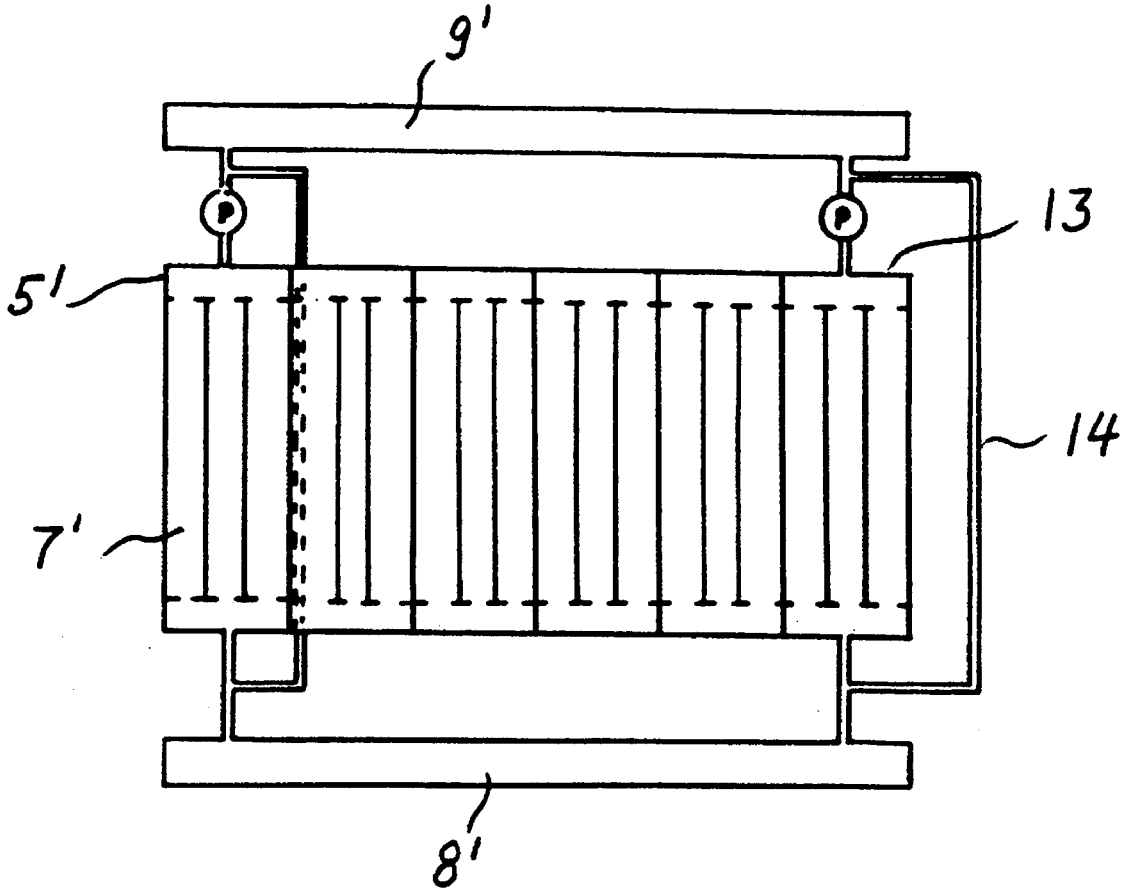
FIG. 4 is a more sophisticated flow diagram for a heat shield according to the invention.

FIG. 4 illustrates a heat shield 5' with channels 7'. Here, the heat shield 5' is sectioned, i.e., it is divided up in this case into six sections 13, each having three ducts or channels 7'. Each section 13 is connected to an inlet manifold 8' and an outlet manifold 9'. In FIG. 4, it is only the illustrated right and left sections 13 which are shown connected to the respective manifolds, but all six sections are connected to the manifolds in the same way as shown to the left and the right in FIG. 4.

A by-pass 14 is provided for each section 13. A pump P is installed in the thus formed by-pass circuit.

In the embodiment shown in FIG. 4, each individual section 13 can be temperature controlled, independent of one another. This takes place by disconnecting/connecting the respective by-pass circuit 14.

FIGS. 3 and 4 are merely purely schematic illustrations, and valves, temperature sensors and so forth are not shown.

Having described our invention, we claim:

1. A device for the heat treatment of paper-making machine textiles, which travel in a longitudinal direction in the form of a band over a heatable roller, said device comprising: a heatable shield for applying heat to the band traveling over the roller from the outside of the band, said shield extending along a part of the periphery of the roller and adapted to the curvature of the roller, said shield having internal channels for the through-flow of a heating medium, said channels being oriented in said longitudinal direction and including means for emitting different amounts of heat individually or by section, so as to obtain a temperature gradient transverse to said band.

2. The device according to claim 1, wherein the channels are grouped in sections which are each connected to an inlet and an outlet manifold.

3. The device according to claim 2, further comprising a by-pass circuit for each section, each by-pass circuit having a pump.

* * * * *